US005507329A

United States Patent [19]

Shub

[11] Patent Number: 5,507,329

[45] Date of Patent: Apr. 16, 1996

[54] LIQUID DISPENSING APPARATUS

[75] Inventor: Michael Shub, Richmond Hill, Canada

[73] Assignee: Professor Purewater Co. Ltd.

[21] Appl. No.: 220,532

[22] Filed: Mar. 31, 1994

[30] Foreign Application Priority Data

Oct. 29, 1993 [CA] Canada ..... 2102060

[51] Int. Cl.[6] ..... B65B 43/42; B65B 63/08

[52] U.S. Cl. ..... 141/351; 141/18; 141/94; 141/165; 141/198; 222/129.1

[58] Field of Search ..... 141/18, 21, 97, 141/198, 206, 217, 227, 94, 95, 96, 165, 250, 269, 279, 348, 349, 351; 222/129.1, 130, 131, 132, 146.6

[56] References Cited

U.S. PATENT DOCUMENTS

| | | | |
|---|---|---|---|
| 3,048,206 | 8/1962 | Keller et al. | 141/371 |
| 3,916,963 | 11/1975 | McIntosh | 141/198 |
| 4,202,387 | 5/1980 | Upton | 141/94 |
| 4,323,090 | 4/1982 | Magi | 141/279 |
| 4,905,743 | 3/1990 | Gray | 141/95 |
| 4,911,212 | 3/1990 | Burton | 141/165 |
| 5,133,393 | 7/1992 | McGinnis | 141/372 |

*Primary Examiner*—Renee S. Luebke
*Assistant Examiner*—Steven O. Douglas
*Attorney, Agent, or Firm*—George A. Seaby

[57] ABSTRACT

In general, distilled water dispensers used in commercial establishments such as drug and convenience stores are unimaginative, coin operated and often messy devices. A relatively simple substitute for such dispensers includes a large housing similar in size and shape to a soft drink dispenser, a smaller housing in the large housing with essentially only the door of the inner housing extending out of the center of the larger housing. A one, three or five gallon bottle is placed in the inner housing and the door is closed. These two actions close two switches which cause a dispensing head to descend from a rest position into the open mouth of the bottle. Movement of the dispensing head to the dispensing position closes a third switch, which causes a solenoid valve to open permitting the flow of distilled water to the bottle. When the bottle is full, the rising water in the bottle closes a circuit including two wire probes extending downwardly into the bottle from the dispensing head to close the solenoid valve and to return the dispensing head to the rest position.

12 Claims, 8 Drawing Sheets

LIQUID DISPENSING APPARATUS

BACKGROUND OF THE INVENTION

1. Field of the Invention

This invention relates to a liquid dispensing apparatus, and in particular to a distilled water dispensing apparatus.

2. Discussion of the Prior Art

Distilled water is available in many drug or convenience stores. The typical dispenser is similar in some respects to a coffer dispenser, including a casing containing an opening for receiving a bottle and a coin operated valve for dispensing a predetermined quantity of liquid. Alternatively, the dispenser is manually operated, necessitating the pressing of a button for a period of time dependent upon the volume being dispensed. One problem with such dispensers is a lack of versatility, i.e. the dispensers are designed to receive bottles of one size only. Moreover, it is necessary to carry the correct coins to operate the machine. The machines can be messy, having an open front permitting removal of the bottle before filling has been completed. An open front may also present health hazards. In the absence of good valves, filling may be inaccurate, i.e. the same quantity of liquid may not be dispensed each time the dispenser is used.

Some advances have been made in elements of dispensers of the above described type. In this connection, reference is made to U.S. Pat. Nos. 3,048,206, issued to R. Keller et al on Aug. 7, 1961; 3,916,963, issued to L. D. Mcintosh on Nov. 4, 1975 and 5,133,393, issued to J. F. McGinnis on Jul. 28, 1992. While the patented devices afford solutions to some of the problems mentioned above, they do not solve all of the problems.

GENERAL DESCRIPTION OF THE INVENTION

An object of the present invention is to provide solutions to all of the problems in question by providing a relatively simple liquid dispenser which is neat, versatile and easy to use, and which ensures that the same quantity of water is always dispensed to a container of a given capacity.

Another object of the invention is to provide a dispensing apparatus which is completely enclosed and thus easy to keep clean, and which meets or exceeds all health guidelines.

Accordingly, the invention relates to an automatic liquid dispensing apparatus comprising housing means for receiving a container, door means in said housing means permitting access to the housing means; dispensing head means in said housing means connected to a supply of liquid under pressure for dispensing liquid into the containers; first valve means controlling the flow of liquid from said source of liquid under pressure to said dispensing head means; first switch means for closing by said door means when the door means is moved from an open to a closed position, said first switch means preventing opening of said first valve means unless the door is closed; second switch means for closing by a container when the latter is correctly positioned in said housing means in alignment with said dispensing head for moving said dispensing head means into a dispensing position with respect to the container; third switch means on said dispensing head means for closing when the dispensing head is in the dispensing position to open said first valve means, whereby liquid is dispensed through said first valve means into the container; and sensor means on said dispensing head means for extending into the container for closing said first valve means when the liquid reaches a predetermined level in the container.

BRIEF DESCRIPTION OF THE DRAWINGS

The invention will be described in greater detail with reference to the accompanying drawings, which illustrate a preferred embodiment of a liquid dispensing apparatus in accordance with the present invention, and wherein.

DESCRIPTION OF PREFERRED EMBODIMENT

Figure 1:
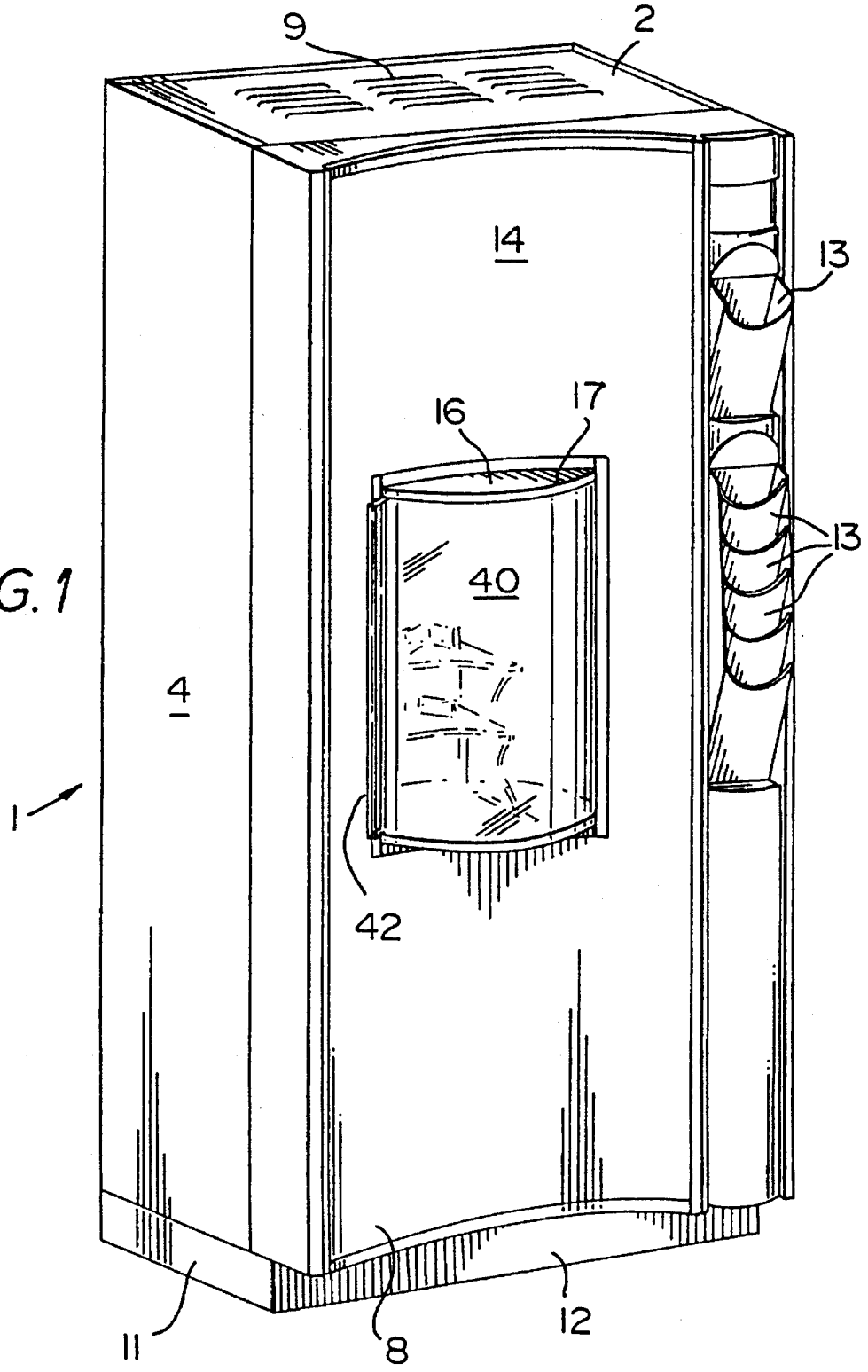
FIG. 1 is a schematic, perspective view from the front and one side of a liquid dispensing apparatus in accordance with the present invention.
Figure 2:
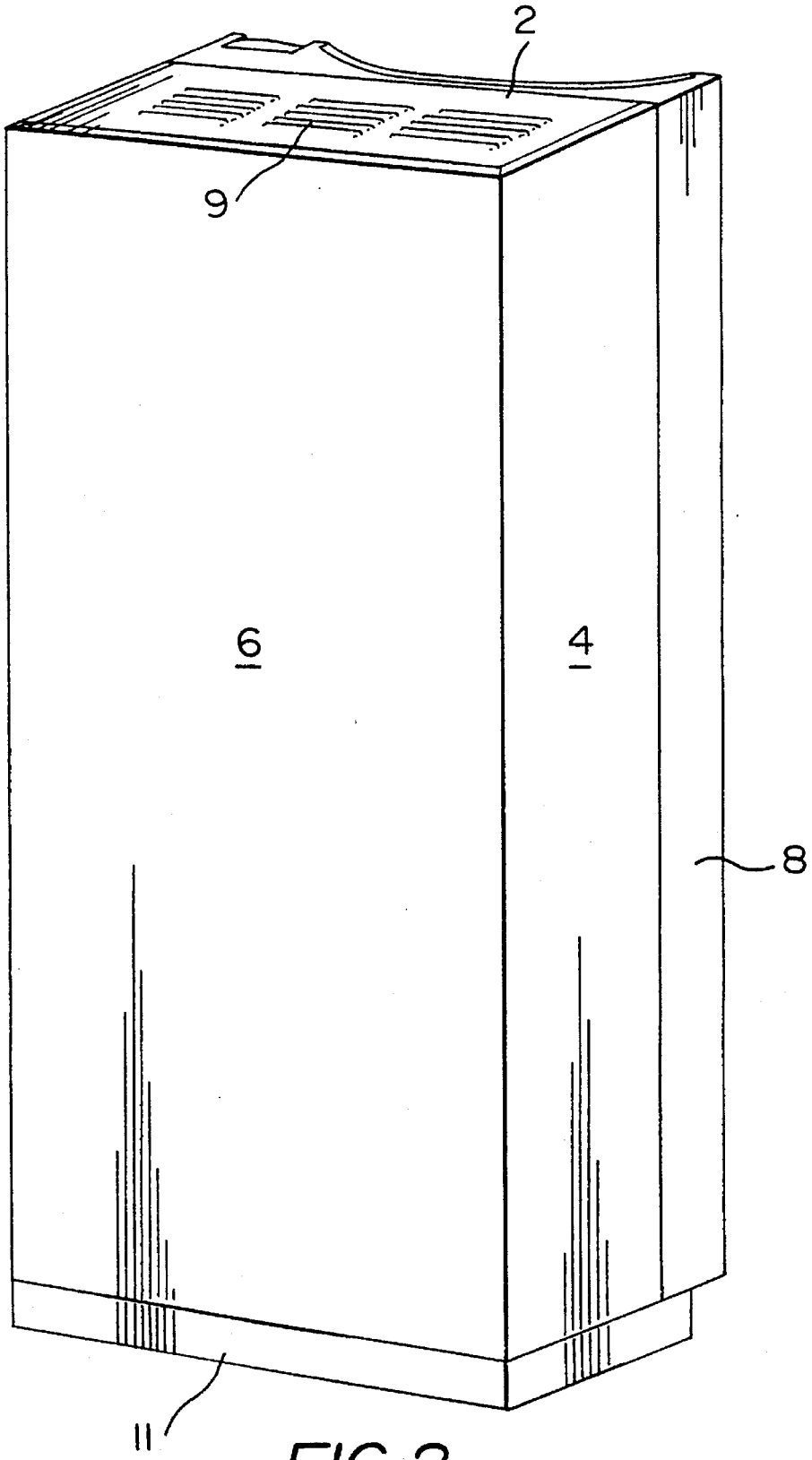
FIG. 2 is a perspective view from the rear and above of the liquid dispenser of FIG. 1.
Figure 4:
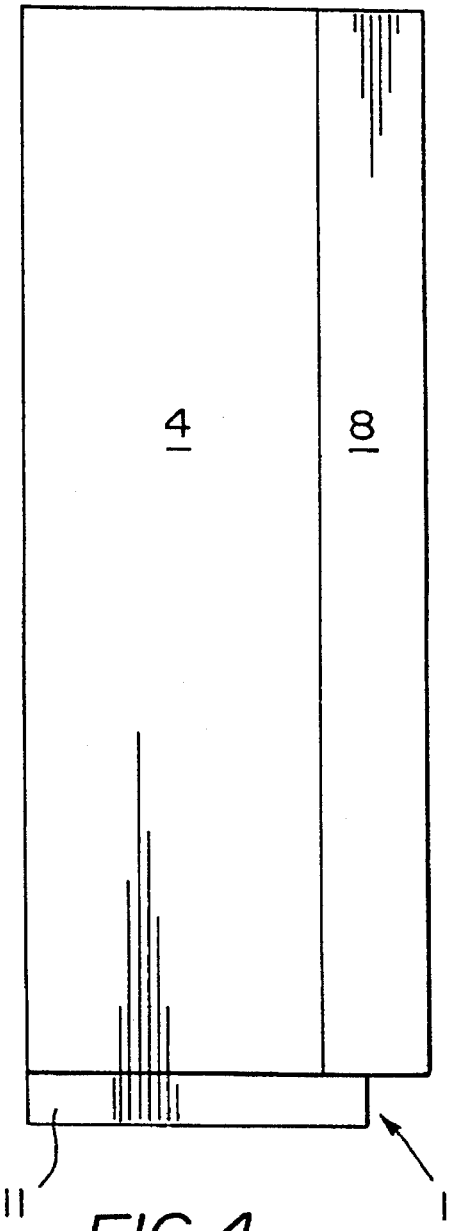
FIG. 4 is a side view of the liquid dispenser of FIGS. 1 to 3.
Figure 3:
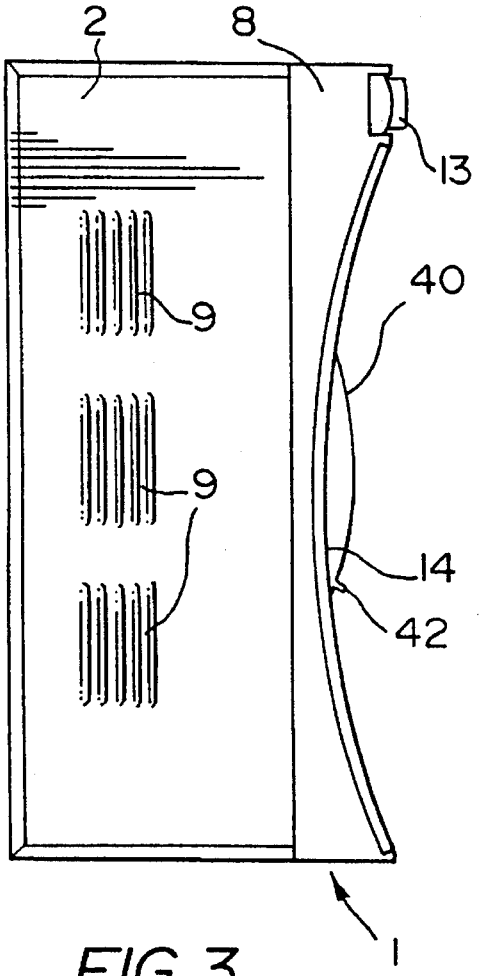
FIG. 3 is a top view of the liquid dispenser of FIGS. 1 and 2.

With reference to FIGS. 1 to 5, the apparatus of the present invention includes a rectangular casing which is generally indicated at 1 defined by a top wall 2, a bottom wall 3, side walls 4 and 5, a rear wall 6 extending between the top, bottom and side walls, and a door 8 for closing the open front end of the housing 1. Louvers 9 are provided in the top wall 2 for ventilating the interior of the housing. A base 11 is provided on the bottom of the housing 1, the front 12 of the base defining a kick-plate when the door 8 is in the closed position (FIGS. 1 and 2). Inclined, plastic pockets 13 are provided on one side of the door 8 for receiving brochures or other papers. The front surface 14 of the door 8 is concave, and includes a rectangular central opening 16 (FIG. 1) through which a portion of a inner housing 17 projects when the door is closed.

Figure 5:
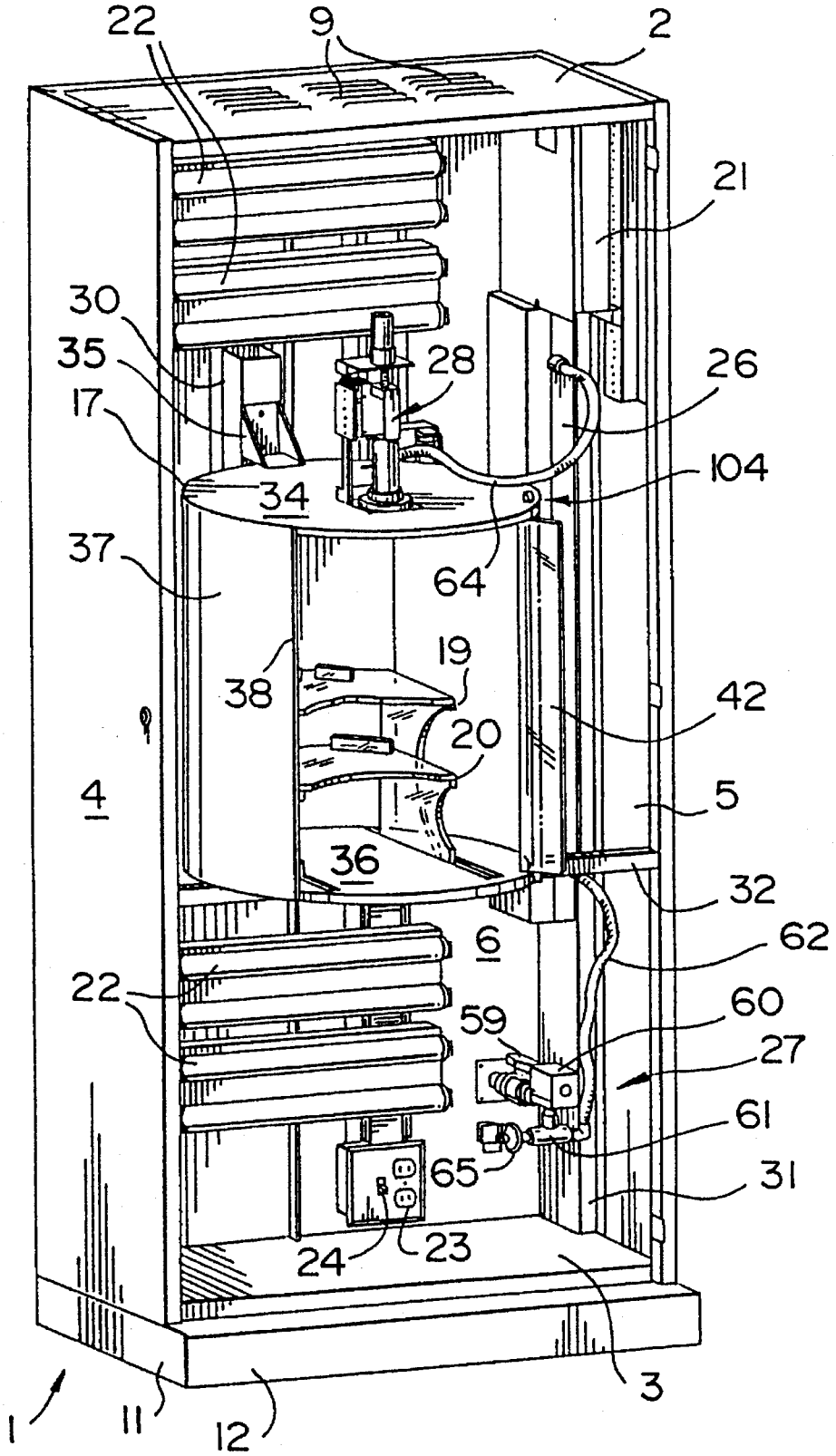
FIG. 5 is a schematic, perspective view from the front and one side of the liquid dispenser of FIGS. 1 to 4 with the door thereof removed and other parts omitted.

Referring specifically to FIG. 5, the principle elements of the apparatus found in the housing 1 include the inner housing 17, container stands 19 and 20, an electronic control panel 21, fluorescent lights 22, electrical sockets 23 and a switch 24, an ultraviolet unit 26, a water inlet assembly generally indicated at 27, an a dispensing head 28. The fluorescent lights 22 merely provide back lighting for the door 8 of the housing, which includes a panel for transmitting some of the light. The lights also illuminate the inner housing at least a portion of which is transparent as described hereinafter. Channels 30 and 31 are provided on the rear and side walls, respectively of the housing 1 for supporting the various elements listed above. The elements 30 and 31 also provide conduits for electrical wires. The inner housing 17 is supported on a front crossbar 32 and by top and bottom brackets 35 (only top shown) on channels 30.

The inner housing 17 includes a top wall 34, a bottom wall 36 and a generally cylindrical, transparent plastic side wall 37. An opening 38 is provided in the front of the side wall 37 permitting access to the inner housing 17. The opening 38 is normally closed by an arcuate, acrylic door 40, which is slidably mounted in an annular groove 41 in the bottom wall 35 of the housing 17. A rectangular handle 42 extends outwardly from one side of the door 40 along the entire length thereof for manually moving the door between the closed and open positions.

Figure 6:
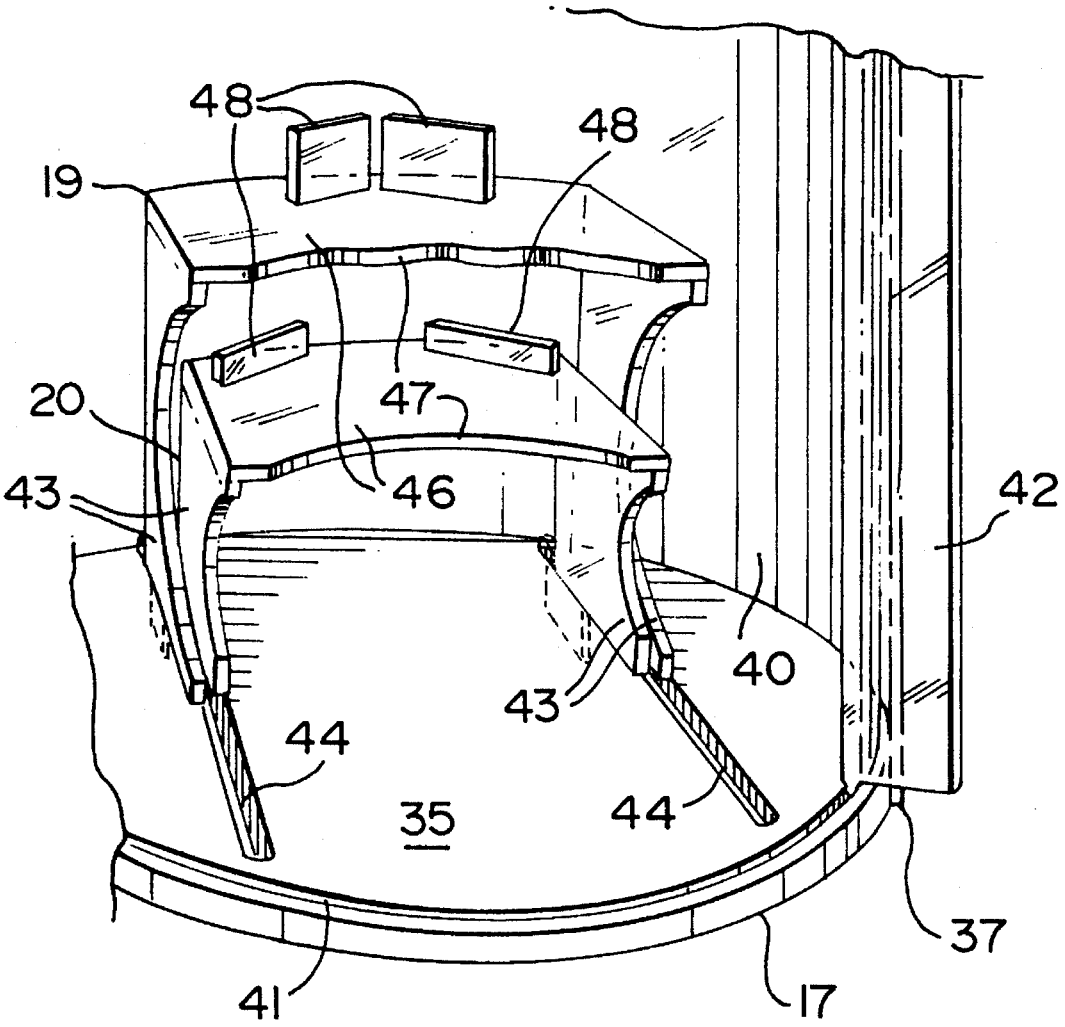
FIG. 6 is a perspective view of a container holder used in the dispensing apparatus of FIGS. 1 to 4.

Four different sized containers (not shown), which are usually blow molded bottles, can be filled using the dispensing apparatus. A five gallon bottle is merely slid into the housing 17 and rests on the bottom wall 36 of the housing during filling. When not in use, the stands 19 and 20 rest at the rear of the housing 17 (FIG. 6). When filling a one or two gallon bottle, the top stand 19 is slid forward for use, and when filling a three gallon bottle, the bottom stand 20 is used. Each of the stands 19 and 20 includes sides 43 which are slidably mounted in tracks defined by grooves 44 in the bottom wall 35 of the inner housing 17, and a top 46 extending between the sides 43. The front edges 47 of the top 46 are contoured for accommodating bottles resting on the bottom wall 35 or the lower stand 20. Guide walls 48 extend upwardly form the tops 46. The walls 48 on each top wall are perpendicular to each other for receiving one corner of a square cross section container. The use of the walls 48 ensures that the container is properly positioned in the inner housing 17 in alignment with the dispensing head 28.

Figure 7:
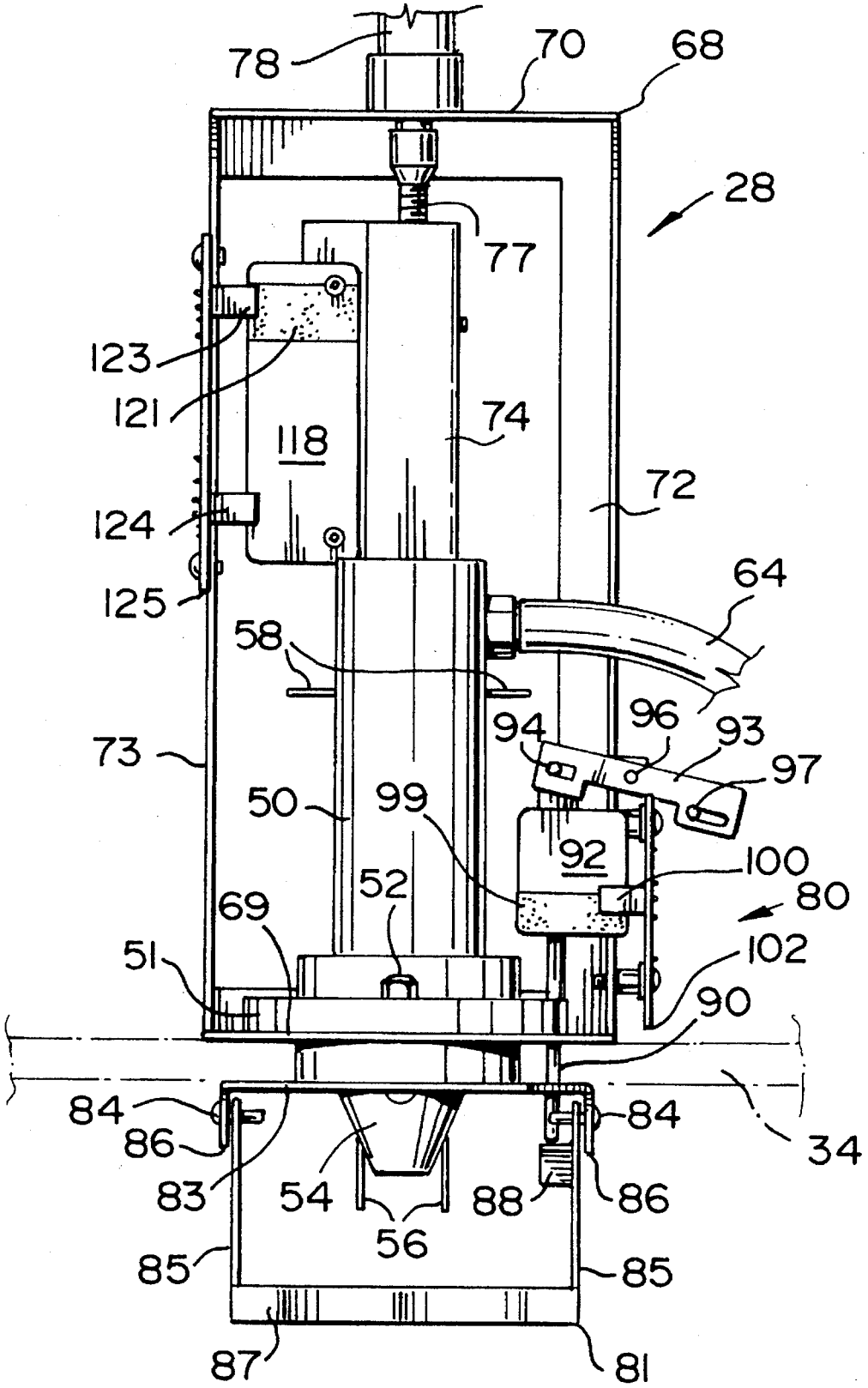
FIG. 7 is a front view of a dispensing head used in the apparatus of FIGS. 1 to 4.
Figure 8:
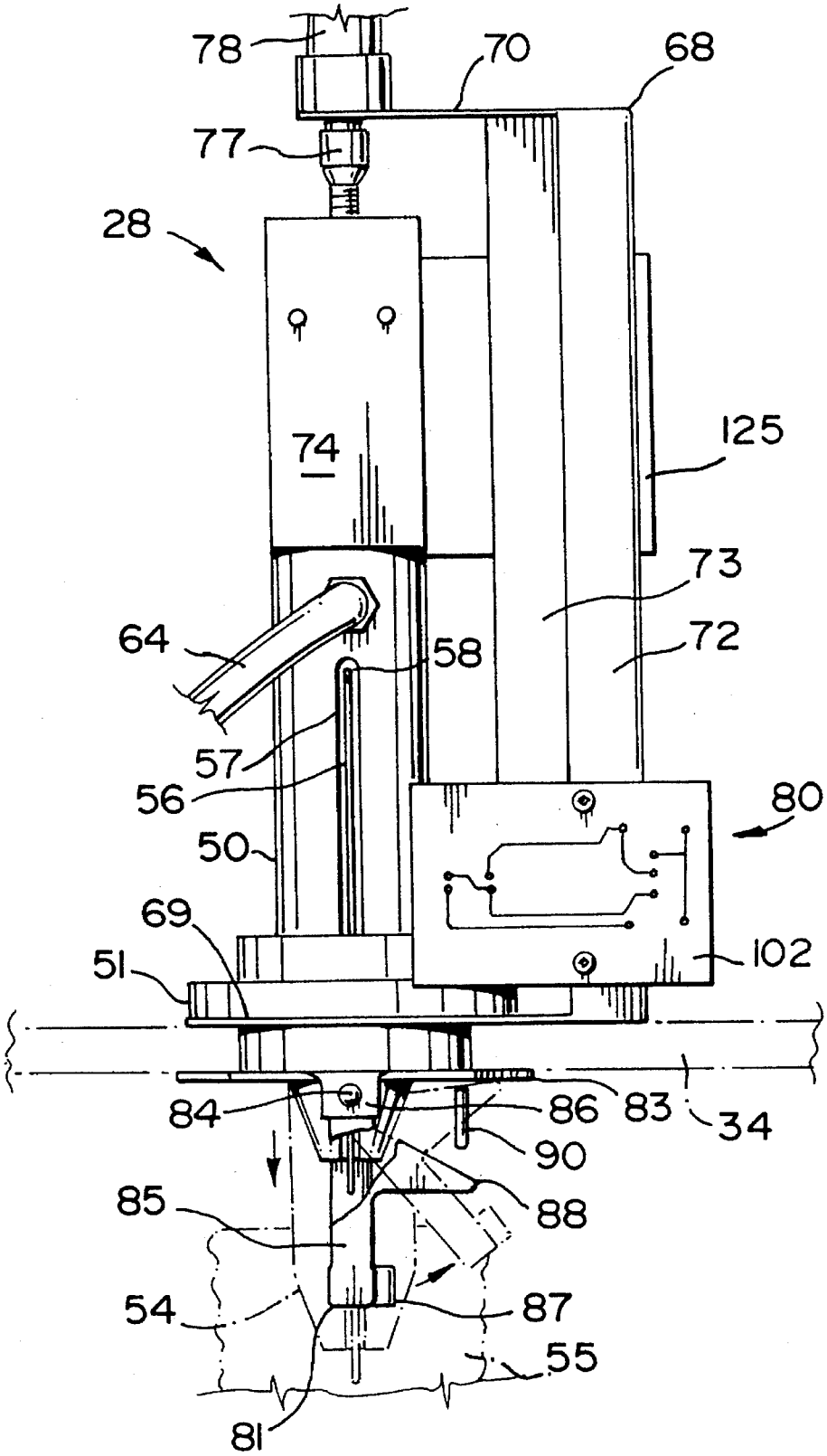
FIG. 8 is a side view of the dispensing head as seen from the right of FIG. 7.
Figure 9:
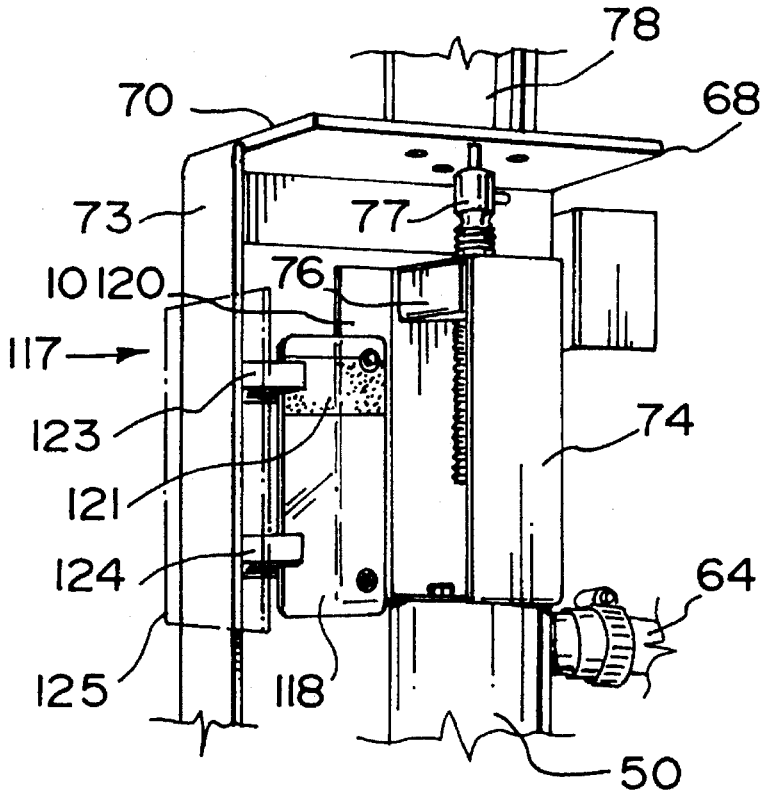
FIG. 9 is a perspective view of portion of the dispensing head as seen from the left of FIG. 7.
Figure 10:
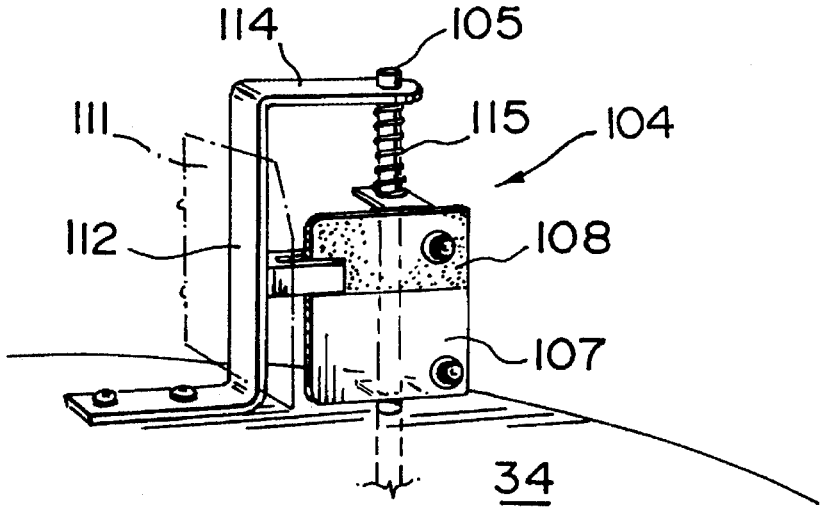
FIG. 10 is a perspective view of a door actuated switch.

Referring to FIGS. 7 and 9, the dispensing head is mounted on the top wall 34 of the housing 17. The dispensing head 28 includes a cylindrical plastic (polyethylene) barrel 50 which is slidably mounted in a bushing 51 in the top wall 34 of the inner housing 17. The bushing 51 is retained in position by bolts 52 (one shown). The bottom end of the barrel 50 is tapered to define a nozzle 54 for insertion into the open top end of a plastic bottle 55 (FIG. 8). A pair of inverted L-shaped wires or probes 56 extend downwardly from grooves 58 in the opposite sides of the barrel 50 through the nozzle 54 for detecting the water level in the bottle 54. When the water, which acts as a conductor, closes a circuit between the probes 56, the flow of water through the nozzle ceases. The top ends 58 of the wires 56 are connected to the control panel 21 by leads (not shown).

As shown in FIG. 5, water is introduced into the dispensing head 28 via a manually operable inlet valve 59, a solenoid valve 60, a tee-joint 61, a tube 62, the ultraviolet unit 26 and a tube 64. A pressure sensor 65 is connected to the joint 61 for continuously monitoring the water pressure. If the water pressure drops below a predetermined pressure, the sensor 65 transmits a signal to the control panel 21, which causes the valve 60 to close. The ultraviolet unit 26 is an off-the-shelf item which exposes the water to ultraviolet radiation to kill any bacteria in the water. The unit 26 is either hard wired into the control circuit (not shown) in the panel 21 or is merely plugged into an outlet 23.

Referring to FIGS. 7 to 9, a metal frame 68 is provided on the top wall 34 of the inner housing 17. The frame 68 includes a bottom plate 69 sandwiched between the flange 51 and the casing top wall 34, a top plate 70 and a pair of side posts 72 and 73 extending between the bottom and top plates 69 and 70. A metal box 74 is mounted on the top end of the barrel 50. The box 74 includes a compartment 76 in the top end thereof containing a floating block or nut (not shown). The threaded shaft 77 of a small reversible motor 78 mounted on the top plate 70 extends into the floating nut, so that rotation of the shaft 77 results in vertical movement of the box 74 and consequently of the barrel 50 and the nozzle 54 integral therewith.

Movement of the dispensing head 28 and the flow of water through the nozzle 54 are controlled by a plurality of switches and by the solenoid valve 60. One such switch, which is generally indicated at 80 (FIGS. 7 and 8) is actuated by a lever 81 attached to the bottom end of the barrel 50. The lever 81 is pivotally mounted in a generally C-shaped bracket 83 mounted on the bottom of the housing top wall 35. Aligned pins 84 extend through side arms 85 of the lever and the arms 86 of the bracket 83, so that the lever is freely rotatable around the aligned longitudinal axes of the pins. An arcuate crossbar 87 extends between the bottom ends of the arms 85. When a bottle is properly positioned in the housing 17, the neck of the bottle pushes the lever 81 rearwardly, so that an arm 88 extending rearwardly therefrom moves through an arc to push a pin 90 upwardly. The pin 90, which is slidably mounted in the top wall 34 of the housing 17 and the plate 69, is part of the switch 80.

The remainder of the switch 80 is located above the inner housing top wall 34. A generally rectangular flag 92 is mounted on the pin 90 for movement therewith. The flag 92 and the pin 90 are suspended from one end of a lever 93 by means of a pin 94. The lever 93 is pivotally mounted on the post 72 by a bolt 96 for rotation around the longitudinal axis of such bolt. A second bolt 97, which acts as a counterweight, is provided in the large free end of the lever 93. The lever 93 ensures that the flag 92 follows the pin 90 during downward movement thereof from the elevated position.

The flag 92 is transparent except for an opaque strip 99 at the bottom end thereof. The flag 92 slides between the arms of a photocell 100 for occluding or exposing the light therein to open or close the switch. The photocell 100 is mounted on a small printed circuit board 102, which is connected to the control panel 21. The board 102 is supported by the post 72.

A similar switch generally indicated at 104 is provided near the edge of the top wall 34 of the casing 17 for actuation by the opening and closing of the door 40. It will be noted that the switch 104 is represented by a small projection in FIG. 5. Like the switch 80, the switch 104 includes a pin 105 slidably mounted in the top wall 34 of the housing. The pin 105 carries flag 107 with an opaque strip 103 thereon for occluding a photocell 110. The photocell 110 is carried by a small printed circuit board 111, which is mounted on a stand 112 defined by a metal strip attached to the top wall 34 of the inner housing 17. The pin 105 extends through a top horizontal arm 114 of the stand 112. A helical spring 115 is provided between the top of the flag 107 and the arm 114. When the door 40 is opened, the pin 105 moves upwardly compressing the spring 115. When the door 40 is closed, the spring 115 pushes the flag 107 and consequently the pin 105 downwardly, so that the flag occludes the photocell 110 to close the switch 104.

A third switch generally indicated at 117 (FIG. 9) includes a flag 118 mounted on a flange 120 extending outwardly from one side of the box 74. Like the other flags, the flag 118 includes an opaque portion 121 for occlusion by photocells 123 and 124. The photocells 123 and 124 are mounted on a printed circuit board 125, which electrically connects the photocells to the control panel 21.

Other sensors and switches can be provided in the apparatus. Because they do not affect the basic operation of the apparatus, the switches are neither illustrated nor described in detail. The sensors include a UV sensor in the unit 26 for providing a signal or for shutting down the apparatus if the UV light sources are not operating. A pressure sensor can be provided in the water inlet line upstream of the valve 59 for ensuring that the water pressure into the unit is within the correct range for proper functioning of the apparatus.

In use, the customer opens the door 40 and inserts the bottle into the inner housing 17. With the door 40 open, the switch 104 is open, preventing opening of the solenoid valve 60 and the flow of water to the dispensing head 28. The bottle is placed in the proper position, either against the stands 19 and 20 or on one of such stands, which is first slid forward to the front of the tracks defined by the grooves 44. When the bottle is placed in the proper position, the lever 81 is pushed rearwardly to raise the pin 94 and the flag 92, i.e. to close the switch 80. When both of the switches 104 and 80 have been closed, the motor 78 starts to rotate the shaft 77, thus lowering the barrel 50 of the injection head 28 so that the nozzle 54 moves to the dispensing position shown in phantom outline in FIG. 8, i.e. the nozzle enters the open neck of the bottle. When the opaque portion 121 of the flag 118 occludes the bottom photocell 124, the barrel 50 stops moving and the solenoid valve 60 opens so that water flows into the bottle.

The water rises in the container until it reaches the level of the tops of the probes 56, which means that the container is full. The probes 56 complete a circuit, causing closing of the solenoid valve 60 and actuation of the motor 78 in the opposite direction to raise the injection head, i.e. the barrel 50 to the rest or starting position. The door 40 is opened, the bottle is removed and the door is again closed to return to the start condition. If the door is opened during operation of the apparatus, the switch 104 is opened causing closing of the solenoid valve 60 and terminating the flow of water. If the door is again closed with the container still in position (i.e. with the switch 80 still closed) the flow of water is resumed to fill the container.

I claim:

1. An automatic liquid dispensing apparatus comprising housing means for receiving a container; door means in said housing means permitting access to the housing means; dispensing head means in said housing means connected to a supply of liquid under pressure for dispensing liquid into the container; first valve means controlling the flow of liquid from said source of liquid under pressure to said dispensing head means; first switch means for closing by said door means when the door means is moved through a path of travel from an open to a closed position, said first switch means preventing opening of said first valve means unless the door is closed; second switch means for closing by a container when the container is correctly positioned in said housing means in alignment with said-dispensing head means for moving said dispensing head means into a dispensing position with respect to the container; third switch means on said dispensing head means for closing when the dispensing head means moves into the dispensing position to open said first valve means, whereby liquid is dispensed through said first valve means into the container; and sensor means on said dispensing head means for extending into the container for sensing a liquid level in the container and for closing said first valve means when the liquid reaches a predetermined level in the container.

2. An apparatus according to claim 1, wherein said dispensing head means includes barrel means for receiving the liquid under pressure; nozzle means on a bottom end of said barrel means for discharging liquid into a container; and motor means for actuation by closing of said first and second switch means to move the nozzle means from a rest position to a dispensing position in an open top end of the container, and by said sensor means to return the nozzle means to the rest position.

3. An apparatus according to claim 2, wherein first switch means includes first pin means slidably mounted in said housing means in the path of travel of said door means; first photosensor means on said housing means; and first flag means on said first pin means for occluding the first photosensor means when the door means is closed to close the first switch means.

4. An apparatus according to claim 3, wherein said second switch means includes lever means rotatable in said housing means for engagement by a container during insertion of the container into said housing means; second pin means for engagement by said lever means when the lever means is rotated by a container; second photosensor means on said housing means; and second flag means on said second pin means occluding said second photosensor means when the container is properly positioned in said housing means to initiate operation of said motor means.

5. An apparatus according to claim 4, wherein said third switch means includes third photosensor means on said housing means; and third flag means on said barrel means for movement therewith for occluding said third of photosensor means during movement of said barrel means between the rest and dispensing positions.

6. An apparatus according to claim 5, including stand means in said housing means for supporting containers in the dispensing position, whereby the apparatus can be used to fill different sizes of containers.

7. An apparatus according to claim 6, including track means in said housing means slidably supporting said stand means for movement between storage and use positions.

8. An apparatus according to claim 7, wherein said housing means includes an outer housing; and an inner housing mounted in said outer housing, said inner housing projecting out of said outer housing and containing said door means and said dispensing head means; and said water housing containing said inner housing and said first valve means at a location remote from said inner housing.

9. An apparatus according to claim 8, wherein said first valve means is a solenoid valve in said outer housing for controlling the flow of liquid to the dispensing head means in the inner housing.

10. An apparatus according to claim 9, including a manually operated inlet valve upstream of the solenoid valve in the direction of liquid flow for controlling the flow of liquid to the solenoid valve.

11. An apparatus according to claim 10, including pressure sensor means downstream of said solenoid valve in the direction of liquid flow for stopping the flow of liquid to the dispensing head if the liquid pressure is outside of predetermined limits.

12. An apparatus according to claim 10, including an ultraviolet unit between said solenoid valve and said dispensing head means for irradiating the liquid to kill any bacteria therein before dispensing.

* * * * *